US006726354B1

(12) United States Patent
Breuer et al.

(10) Patent No.: US 6,726,354 B1
(45) Date of Patent: Apr. 27, 2004

(54) DEVICE FOR MIXING AND REACTING MULTIPHASE GASEOUS AND LIQUID MIXTURES AND USE OF THIS DEVICE

(75) Inventors: Werner Breuer, Krefeld (DE); Frieder Heydenreich, Düsseldorf (DE); Günter Jeromin, Krefeld (DE); Helmut Judat, Langenfeld (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/913,061

(22) PCT Filed: Feb. 7, 2000

(86) PCT No.: PCT/EP00/00788

§ 371 (c)(1),
(2), (4) Date: Aug. 11, 2001

(87) PCT Pub. No.: WO00/47314

PCT Pub. Date: Aug. 17, 2000

(30) Foreign Application Priority Data

Feb. 11, 1999 (DE) ..... 199 05 572

(51) Int. Cl.[7] ..... B01F 3/04

(52) U.S. Cl. ..... 366/163.1; 366/167.1; 261/76; 261/DIG. 75

(58) Field of Search ..... 366/163.1, 167.1, 366/173.1, 177.1, 181.6; 417/165; 261/DIG. 75, 76

(56) References Cited

U.S. PATENT DOCUMENTS

| | | | | |
|---|---|---|---|---|
| 1,826,776 | A | * 10/1931 | Gunther | 239/8 |
| 3,193,257 | A | 7/1965 | Kingma | |
| 3,219,483 | A | * 11/1965 | Goos et al. | 261/76 |
| 3,409,274 | A | * 11/1968 | Lawton | 261/76 |
| 4,123,800 | A | * 10/1978 | Mazzei | 366/181.6 |
| 4,212,544 | A | * 7/1980 | Crosby | 366/173.2 |
| 4,230,410 | A | * 10/1980 | Kastl et al. | 366/178.2 |
| 4,474,477 | A | * 10/1984 | Smith et al. | 366/167.1 |
| 4,625,916 | A | * 12/1986 | Nieuwkamp et al. | 239/431 |
| 4,656,001 | A | * 4/1987 | Roger et al. | 376/292 |
| 4,666,669 | A | * 5/1987 | Mumaw | 366/173.2 |
| 4,743,405 | A | * 5/1988 | Durao et al. | 261/76 |
| 4,761,077 | A | * 8/1988 | Werner | 366/165.1 |
| 5,004,484 | A | * 4/1991 | Stirling et al. | 261/DIG. 75 |
| 5,073,309 | A | * 12/1991 | Bousquet et al. | 261/76 |
| 5,131,757 | A | * 7/1992 | Smith | 366/173.2 |
| 5,338,113 | A | * 8/1994 | Fissenko | 366/181.5 |
| 5,492,404 | A | * 2/1996 | Smith | 366/167.1 |

FOREIGN PATENT DOCUMENTS

| | | |
|---|---|---|
| DE | 28 05 576 | 9/1979 |
| WO | WO 91/00139 | 1/1991 |

* cited by examiner

*Primary Examiner*—Tony G. Soohoo
(74) *Attorney, Agent, or Firm*—Joseph C. Gil; James R. Franks; Aron Preis

(57) ABSTRACT

A device for mixing and reacting multiphase gaseous and liquid mixtures is disclosed. The device comprise in sequence a first inflow cylindrical space, at least one cylindrical chamber tapering towards said cylindrical space, a second cylindrical space positioned perpendicularly to said first cylindrical space, and an outflow space. Also disclosed is a method of using the device, in particular in the interfacial process for preparing diphenyl carbonates or polycarbonates.

18 Claims, 3 Drawing Sheets

DEVICE FOR MIXING AND REACTING MULTIPHASE GASEOUS AND LIQUID MIXTURES AND USE OF THIS DEVICE

FIELD OF THE INVENTION

The invention relates to a device for mixing and reacting multiphase gaseous and liquid mixtures wherein non homogeneously miscible liquid homogeneous solutions are brought into intensive contact with homogeneous solutions in which several solid or liquid substances or several gases are dissolved, and to the use of said device, and diphenyl carbonate and polycarbonate prepared with the aid of the device.

BACKGROUND OF THE INVENTION

It is known to mix homogeneous solutions which are insoluble in one another in order to accelerate the reaction of the individual substances with one another in the solutions. This mixing takes place by stirring, mechanical mixing or the like, as described, for example, in EP 0 228 670 A2, where a process for the preparation of diaryl carbonates is claimed.

A disadvantage of using stirrers or other mechanical mixers is bringing shaft bearings into the stirred-tank reactor or reactor, and the shaft gland out of the stirred-tank reactor or reactor, on the one hand in view of the sealing and on the other hand with regard to the cleaning of the known mixers. The structural design of the shaft bearings as a shaft gland in large stirred-tank reactors is therefore very complex and associated with considerable expense.

Moreover, the known stirred-tank reactors or mixers cannot be enlarged at will since a chemical reaction also frequently takes place during mixing, so that enthalpy of mixing and/or reaction is liberated or required in the reactor during the mixing process. In order to dissipate the enthalpy towards the outside or to feed it into the interior of the reactor, additional heat exchangers are required in the case of very large mixers, since the ratio of heat exchange surface to the reactor volume decreases as the stirred-tank reactor radius increases. In these cases, the stirred-tank reactor volume is reduced by increasing the number of stirred-tank reactors, or the heat transport is intensified by providing additional heat exchangers in the secondary flow.

SUMMARY OF THE INVENTION

The object of the invention is, therefore, to improve the known device described in more detail above for mixing and reacting multiphase gaseous and liquid mixtures in such a manner that, with little structural complexity, a structurally small mixer is provided which dispenses with shaft bearings and shaft glands in order to avoid the disadvantages described above. Moreover, the quality of the mixture should be improved.

The object is achieved by a nozzle mixer as a reactor with a cylindrical space for the entry of the first solution, at least one cylindrical chamber tapering towards the space, in which chamber the mixing and reaction of at least two solutions takes place, a cylindrical space arranged perpendicularly to the space for the inflow of the second solution, and a space for the outflow of the mixed and reacted solutions out of the nozzle mixer. In order to the reduce the pressure drop, the outflow space in a further embodiment of the invention is provided with a conically widening cross-section.

Surprisingly, it has become apparent that, with the device according to the invention, several separate homogeneous substance streams which cannot be dissolved in one another to give a homogenous solution may be intimately mixed with one another. In so doing, high mixing levels are achieved, as a result of which a rapid reaction of the reactants afterwards is made possible. Moreover, a structurally small mixer can be obtained in a structurally simple manner with the design according to the invention.

Figure 1:
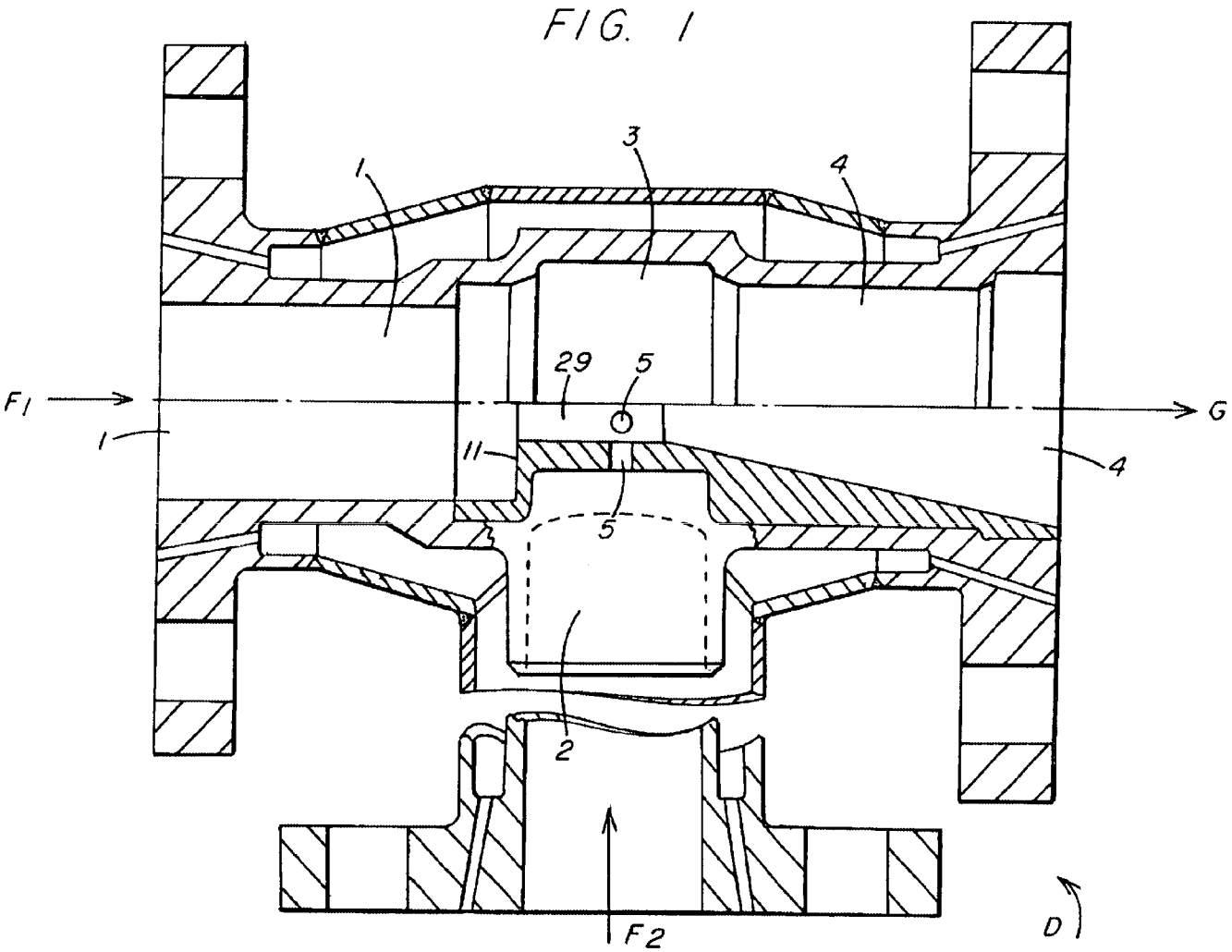
FIG. 1 is a representative sectional view of a nozzle mixer according to the invention.

A further teaching of the invention provides that the transition between the first cylindrical space (1) and the cylindrical mixing chamber (3) is a sharp-edged transition (11) that is substantially perpendicular to the longitudinal axis of the nozzle mixer (as defined by the dashed line between characters $F_1$ and G in FIG. 1). The first liquid stream enters the nozzle mixer via the cylindrical chamber in the direction of the conical space, the second stream enters the central cylindrical chamber of the nozzle mixer perpendicularly. The perpendicular entry of the second solution into the nozzle mixer takes place by way of several openings which, according to a further teaching of the invention, are arranged in a line and distributed uniformly around the circumference in the inner wall (29) of the chamber. The openings preferably run perpendicularly or at any low angle to the longitudinal axis of the chamber. The mixing intensity and the rate of reaction is thereby increased substantially.

A part of the homogenous solutions of solid, liquid and/or gaseous substances may, be prepared in one or more jacketed mixer(s) arranged in front of the nozzle mixer. Each jacketed mixer has a cylindrical mixing space through which the homogenous liquid is fed and a multiplicity of feed pipes are arranged symmetrically around the mixing space for introducing the second liquid to be dissolved or the gas into the jacketed mixer. Moreover, means for the pulsed introduction of the liquid or gas into the jacketed mixer may be provided in order further to improve the degree of mixing.

A further teaching of the invention provides that the cylindrical mixing space has an outer annular space and that the feed pipes are designed as holes in the reactor wall. The holes in the reactor wall preferably run at a low angle to the direction of flow of the reactor. An angle of 45° has proved particularly advantageous.

In order to obtain a high degree of mixing, a further embodiment of the invention provides that the holes in the mixer wall be arranged in rings, the holes being expediently arranged so as to be distributed uniformly around the circumference of each ring. Particularly thorough mixing is obtained if eight holes are arranged on each ring and the holes of adjacent rings in each case are staggered at an angle of 45° in the direction of flow.

Surprisingly, with the jacketed mixer described, it was possible to mix liquids or gases in liquids in such a way that the solutions could be obtained with high degrees of mixing in the attached nozzle mixer.

According to a further teaching of the invention, heat exchangers may be arranged upstream or downstream of the device for mixing and reacting in order reliably to ensure the necessary heat exchange with the mixing and reaction space in order to maintain the required mixing or reaction temperature during mixing processes and reactions with enthalpy changes.

It is particularly advantageous if, in a production process, a plurality of mixers according to the invention are arranged successively in the direction of flow. The demixing of heterogeneous mixtures in the direction of flow is thus reliably avoided.

A further teaching of the invention consists in the use of the above-mentioned device for mixing aqueous alkaline phenolate, bisphenolate solutions or other polyhydric phenolate solutions with solid, liquid and/or gaseous substances dissolved in the solvent.

A further teaching of the invention relates to diphenyl carbonate and polycarbonate, prepared in each case by the interfacial method firm a heterogeneous mixture, prepared by mixing in the device according to the invention, of an aqueous alkaline phenolate or bisphenolate solution with gaseous or liquid phosgene dissolved in dichloromethane, the mixture having a very small residual phenylpiperidyl urethane content of <20 ppm.

Finally, it emerges from the invention that as a result of more intensive mixing and reaction, the reactor volumes obtained are markedly smaller than when stired-tank reactors are used. Due to the lower hold-up, the stationary state is obtained relatively quickly. The result of this is that target products with the desired properties and quality are also obtained within a very short time after start-up. A further result is that unwanted by-products which have to be disposed of are obtained in a relatively small amount.

The invention is explained in more detail on the basis of an example.

In order to prepare diphenyl carbonate with conventional mixers, an aqueous reaction mixture flowed through a cascade of four stired-tank reactors with a total volume of 23 $m^3$ at 30° C. with a throughput of 4,500 kg/h, phosgene and dichloromethane being fed continuously into the first reactor. The aqueous phenolate solution was likewise prepared continuously in a mixing vessel arranged upstream of the first stirred-tank reactor of the cascade.

After the fourth stirred-tank reactor of the cascade, the reaction mixture was separated into two phases in a separating vessel, the organic phase was purified, then the solvent and finally the diphenyl carbonate was distilled.

A yield of 92% and a by-product concentration according to the following list was obtained:

| | |
|---|---|
| Phenylpiperidyl urethane | 13 to 30 ppm |
| Low-boiling products | 15 to 25 ppm |
| High-boiling products | 0 to 90 ppm |

For comparison, the reaction mixture was conveyed through the device according to the invention with the same throughput, the solution of phosgene in dichloromethane being prepared continuously in the jacketed mixer. The aqueous phenolate solution was prepared continuously in a mixing vessel.

The reaction to diphenyl carbonate took place in a nozzle mixer according to the invention, the work-up and preparation of the diphenyl carbonate taking place exactly as in the process using the cascade of stirred-tank reactors.

In this case, a yield of 98% diphenyl carbonate was obtained. The by-product concentration was:

| | |
|---|---|
| Phenylpiperidyl urethane | 11 to 16 ppm |
| low-boiling products | 10 to 25 ppm |
| High-boiling products | 0 to 90 ppm |

In the diphenyl carbonate prepared according to the invention, the proportion of phenylpiperidyl urethane could be reduced reliably to values below 20 ppm, as a result of which a better grade of diphenyl carbonate could be obtained. Finally, the device according to the invention is explained in more detail on the basis of a merely prefferred embodiment, with reference to the drawing figures.

The preferred four-part nozzle mixer D in the embodiment shown contains a cylindrical space 1 into which a first solution $F_1$ enters. A second solution $F_2$ flows via the cylindrical space 2 into a central cylindrical chamber 3. A conical space 4 serves as the outlet. In order to increase the mixing intensity and accelerate the reaction, the central chamber 3 has a smaller diameter than the cylindrical space 1 and the transition between space 1 and chamber 3 is provided with slap edges. With the aid of the conically widening space 4 of the nozzle mixer D, it is possible to keep the pressure drop in the system low.

For the operation of the device according to the invention, the liquid, e.g. the solution of phosgene in dichloromethane $F_1$ enters the central cylindrical chamber 3 by way of cylindrical space 1 and the second solution, e.g., the phenolate solution $F_2$ enters by way of the cylindrical space 2 which is perpendicular to space 1. The second solution is introduced into the cylindrical chamber 3 via openings 5 and mixed with the solution from space 1 flowing perpendicularly thereto and undergoes a reaction. The openings 5 are situated in the shown and thus preferred embodiment in a line on the cylindrical jacket of the central chamber. The mixture G, after mixing and reaction, leaves the nozzle mixer D by way of the conical space 4.

Figure 2:
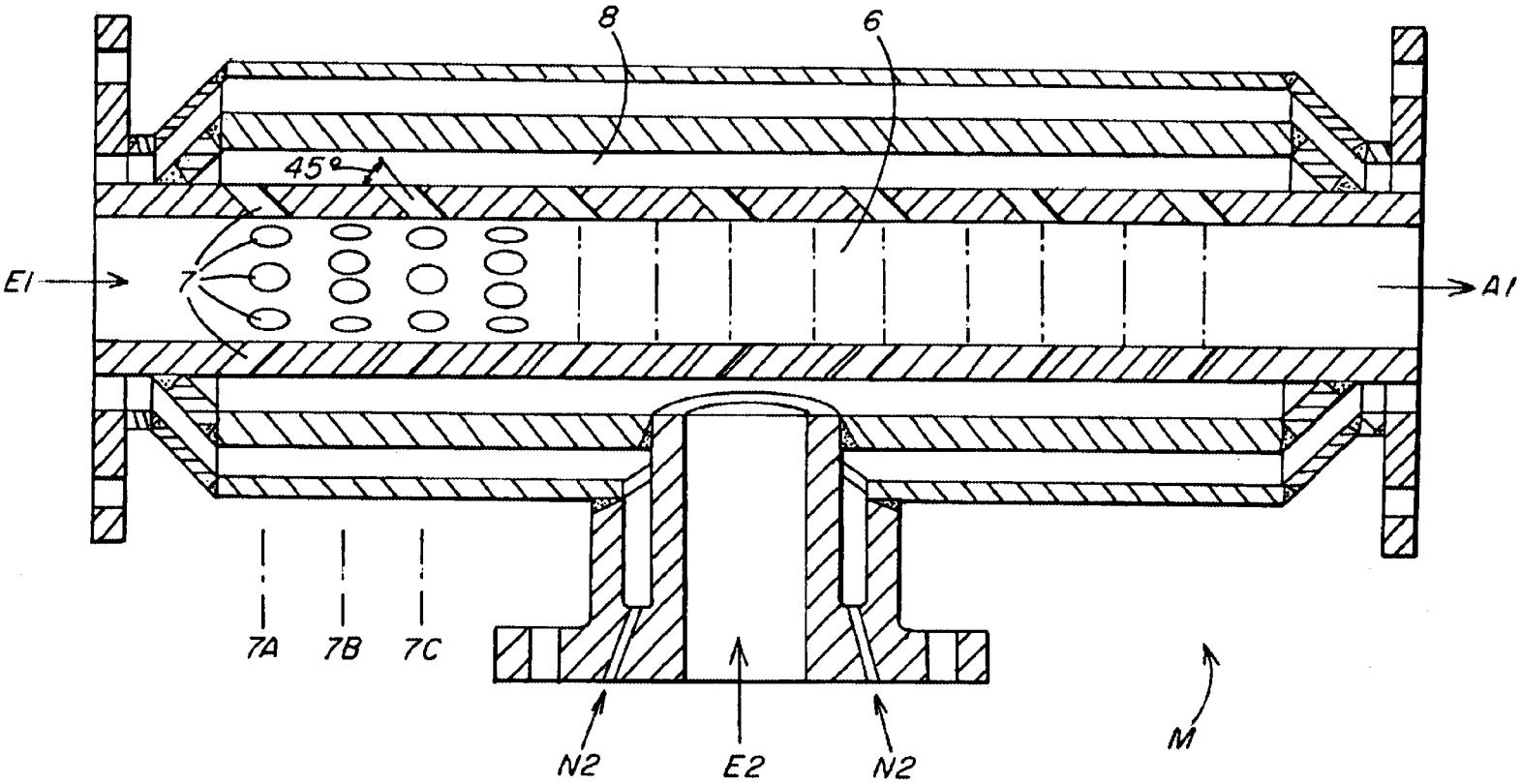
FIG. 2 is a representative sectional view of a jacketed mixer that may be used in conjunction with the nozzle mixer in the present invention.

FIG. 2 shows a cylindrical jacketed mixer M to be arranged upstream of the nozzle mixer D, which mixer has a cylindrical mixing space 6 whose wall is provided with a multiplicity of holes 7 of which, for clarity, only the holes 7 arranged in a ring near the entrance $E_1$ are provided with reference numbers.

In the shown and in this respect preferred embodiment, series of holes, rings 7A, 7B and 7C, are arranged over the length of the jacketed mixer M and distributed uniformly in rings of which, for clarity, again only the left-hand three rings are specified. Each ring 7A, 7B, 7C preferably has eight holes 7 and the openings of two adjacent rings 7A, 7B and 7B, 7C respectively are staggered by 45° in each case. In this way, optimum mixing is obtained inside the mixing space 6 of the jacketed mixer M.

For the operation of the device according to the invention, a first homogeneous liquid, such as, for example dichloromethane, is fed into the reactor space 6 of the jacketed mixer M through the inlet $E_1$.

The second component to be mixed, such as, for example, gaseous or liquid phosgene, is fed via an inlet $E_2$ into an annular space 8 surrounding the mixing space 6 and introduced into the liquid, preferably in a pulsed manner, via the holes 7. As shown in the preferred embodiment, the holes 7 are arranged at an angle of 45°to the direction of flow of the liquid. In this way, optimum mixing of liquid with gas or another liquid can be achieved. The solution leaves the jacketed mixer M through the outlet $A_1$.

It can also be derived from FIG. 1 and FIG. 2 that, in order to monitor phosgene leaks, the entire nozzle mixer D and jacketed mixer M is provided with an annular space, not specified, into which nitrogen ($N_2$) may be admitted.

Figure 3:
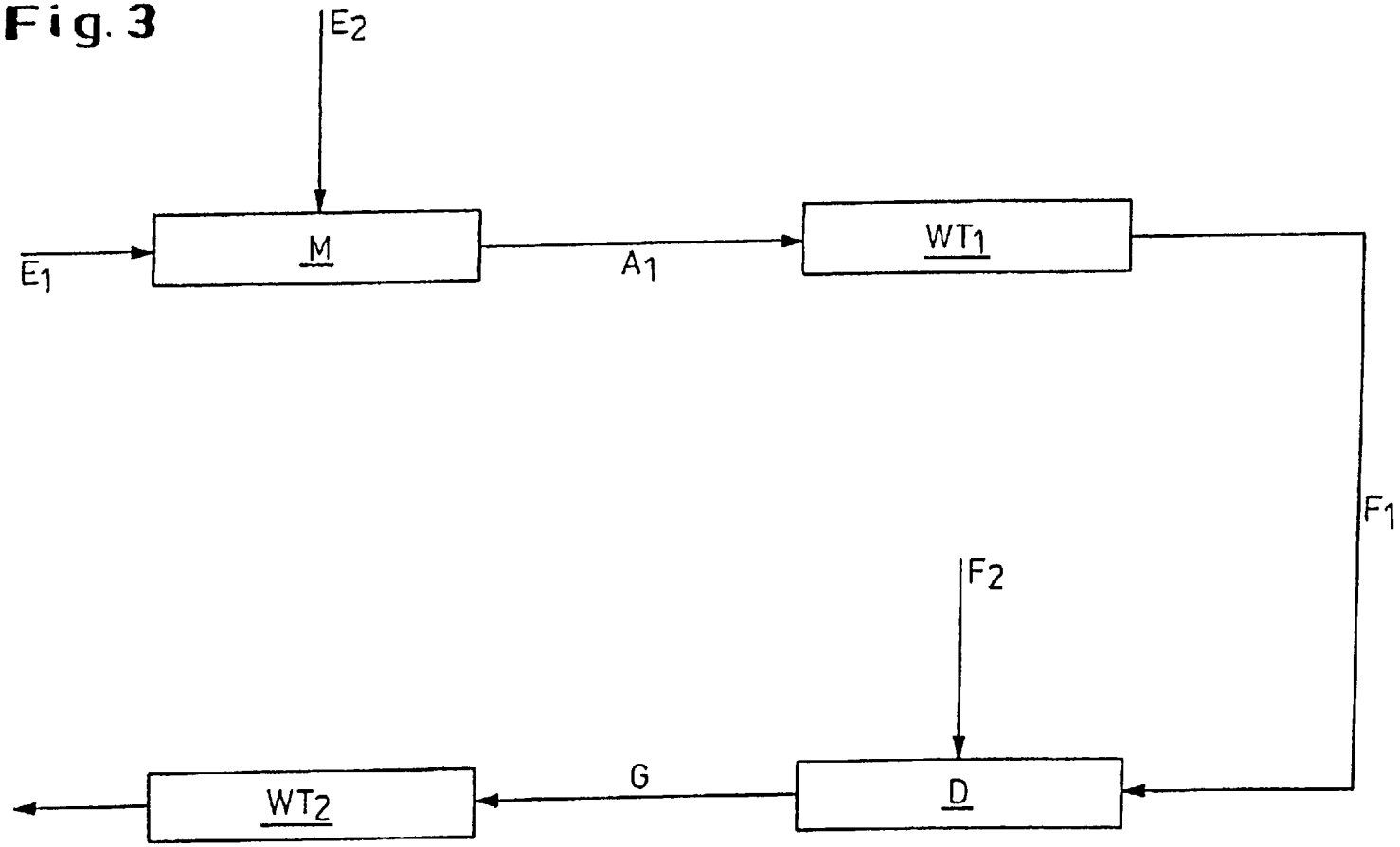
FIG. 3 is a schematic representation of a preferred arrangement of mixers and heat exchangers in the present invention.

Finally, a preferred arrangement of the mixers of the device according to the invention can be seen from FIG. 3 wherein a first heat exchanger $WT_1$ is arranged downstream of the jacketed mixer M and a second heat exchanger $WT_2$ downstream of the nozzle mixer D. In this way, the maintenance of the necessary mixing and reaction temperature can be guaranteed in a reliable manner.

What is claimed is:

1. A device for mixing and reacting multiphase gaseous and liquid mixtures, in which non homogeneously miscible liquid homogeneous solutions are brought into intensive contact with homogenous solutions in which several solid or liquid substances or several gases are dissolved, wherein said device includes a nozzle mixer (D) comprising:

a first cylindrical space (1), which provides an entry for a first solution;

a second cylindrical space (2) arranged perpendicularly to the first cylindrical space (1), said second cylindrical space (2) providing an inflow entry for a second solution; and at least one cylindrical mixing chamber (3) in which mixing and reaction of at least said first and second solutions occurs, said cylindrical mixing chamber (3) being in fluid communication with said second cylindrical space (2), and said cylindrical mixing chamber (3) being in fluid communication with said first cylindrical space (1) by means of a sharp-edged transition (11) that is substantially perpendicular to the longitudinal axis of said nozzle mixer; and an outflow space (4), which provides an outflow for a mixed and reacted solution from the nozzle mixer (D), said outflow space (4) being in fluid communication with said mixing chamber (3).

2. The device of claim 1 wherein the outflow space (4) has a cross section that widens conically in the direction of flow.

3. The device of claim 1, wherein a plurality of openings (5), arranged substantially perpendicularly to the direction of flow of the first solution, are provided in the walls of the chamber (3) for the entry of the second solution into the cylindrical mixing chamber (3).

4. The device of claim 3 wherein said cylindrical mixing chamber (3) has an inner wall, and the openings (5) are provided in the inner wall of the cylindrical mixing chamber (3), the openings (5) being arranged in a line and distributed uniformly over the circumference of the inner wall of cylindrical mixing chamber (3).

5. The device of claim 4 wherein the openings (5) are arranged perpendicularly to the longitudinal axis of the cylindrical mixing chamber (3).

6. The device of claim 4 wherein the openings (5) are arranged at an angle to the longitudinal axis of the chamber (3).

7. The device of claim 1 wherein said device further comprises at least one jacketed mixer (M) in which gaseous or liquid substances may be mixed with liquid substances, said jacketed mixer (M) being positioned upstream of and being in fluid communication with the nozzle mixer (D).

8. The device of claim 7 wherein the jacketed mixer (M) comprises:

a cylindrical mixing space (6), which provides a means for a homogenous liquid to be fed into said jacketed mixer (M); and a multiplicity of feed pipes arranged symmetrically around the mixing space (6), which provide a means for a second liquid or gas to be introduced into said jacketed mixer (M).

9. The device of claim 8 wherein the device further comprises a means for the pulsed introduction of the homogenous liquid and the second liquid or gas into said jacketed mixer (M).

10. The device of claim 8 wherein the cylindrical mixing space (6) has an outer annular space (8), and the feed pipes are in the form of holes (7) in the wall of cylindrical mixing space (6).

11. The device of claim 10 wherein the holes (7) in the wall of the mixing space (6) are arranged in a plurality of rings.

12. The device of claim 11 wherein the holes (7) are distributed uniformly over the circumference of each ring.

13. The device of claim 12 wherein the holes (7) of each ring are staggered in relative to the direction of flow through said cylindrical mixing space (6).

14. The device of claim 13 wherein each ring has eight holes (7) and that the holes (7) of each ring are staggered by 45° relative to the direction of flow through said cylindrical mixing space (6).

15. The device of claim 10 wherein the holes (7) are arranged at a low angle relative to the direction of flow through said cylindrical mixing space (6).

16. The device of claim 15 wherein the low angle is from 30° to 60°.

17. The device of claim 16 wherein the low angle is 45°.

18. The device of claim 7 wherein said device further comprises at least one heat exchanger (WT) that is arranged in a position selected from:

(i) upstream of the nozzle mixer (D);

(ii) downstream of the nozzle mixer (D);

(iii) upstream of the jacketed mixer (M);

(iv) downstream of the jacketed mixer (M); and (v) a combination of at least two of (i)–(iv).

* * * * *